US011692381B2

(12) United States Patent
Vetter et al.

(10) Patent No.: US 11,692,381 B2
(45) Date of Patent: Jul. 4, 2023

(54) TAMPER RESISTANT SASH OPENING LIMITER FOR CASEMENT AND AWNING WINDOWS

(71) Applicant: Truth Hardware Corporation, Owatonna, MN (US)

(72) Inventors: Gregory J. Vetter, Owatonna, MN (US); Zach Pennaz, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 318 days.

(21) Appl. No.: 16/919,273

(22) Filed: Jul. 2, 2020

(65) Prior Publication Data

US 2021/0002931 A1 Jan. 7, 2021

Related U.S. Application Data

(60) Provisional application No. 62/869,827, filed on Jul. 2, 2019.

(51) Int. Cl.

| | |
|---|---|
| ***E05C 17/16*** | (2006.01) |
| ***E05C 17/28*** | (2006.01) |
| ***E05C 17/24*** | (2006.01) |

(52) U.S. Cl.

CPC ..... *E05C 17/16* (2013.01); *E05C 17/24* (2013.01); *E05C 17/28* (2013.01)

(58) Field of Classification Search

CPC ..... E05C 17/32; E05C 17/24; E05C 17/08; E05C 17/30; E05C 17/16; E05C 17/28

See application file for complete search history.

(56) References Cited

U.S. PATENT DOCUMENTS

| | | | | |
|---|---|---|---|---|
| 1,633,645 | A * | 6/1927 | Molberg | E05C 17/14 292/304 |
| 2,760,805 | A * | 8/1956 | Stevens | E05C 17/18 292/268 |
| 2,779,069 | A | 1/1957 | Ziesmer | |
| 2,811,349 | A * | 10/1957 | Bondurant | E06B 3/50 49/248 |
| 3,278,213 | A * | 10/1966 | March | E05C 17/32 292/263 |
| 3,758,919 | A | 9/1973 | Dilworth, Jr. | |
| 4,622,778 | A | 11/1986 | Simpson | |
| RE32,846 | E | 1/1989 | Sandberg et al. | |
| 4,833,754 | A | 5/1989 | Yang | |

(Continued)

FOREIGN PATENT DOCUMENTS

| | | |
|---|---|---|
| GB | 2262565 | 6/1993 |
| GB | 2391901 | 2/2004 |
| GB | 2407116 A | 4/2005 |

*Primary Examiner* — Justin B Rephann

(74) *Attorney, Agent, or Firm* — Bradley J. Thorson

(57) ABSTRACT

A sash limiter assembly for limiting the distance a casement window can be opened. In a jamb mounted version, the limiter is mounted in one constant location on the jamb rather than multiple locations on the sill which results in the opening distance being essentially the same for all window widths and all hinge types. In both the jamb mounted version and a sill mounted version, a hexalobular or other security screw can be used to retain a limiting arm to a stud attached to a bracket, or a stud attached to a slider which slides on a track to inhibit unauthorized removal of the limiter arm.

18 Claims, 12 Drawing Sheets

(56) References Cited

U.S. PATENT DOCUMENTS 4,980,947 A 1/1991 McQuigge
5,090,754 A * 2/1992 Thompson ..... E05C 17/32 292/262
5,491,930 A 2/1996 La See
5,568,702 A 10/1996 Frank et al.
5,711,052 A * 1/1998 Delaske ..... E05D 15/30 16/245
5,802,768 A * 9/1998 Hammer ..... E05F 15/619 403/345
5,920,959 A 7/1999 DeMarco
6,138,325 A 10/2000 Figiola et al.
7,047,600 B2 * 5/2006 Muir ..... E05D 15/30 16/346
7,278,185 B2 10/2007 Smith
7,690,154 B2 * 4/2010 Muir ..... E05D 15/30 49/246
8,505,240 B2 8/2013 Nguyen et al.
8,726,572 B2 * 5/2014 Derham ..... E05C 17/32 49/141
9,115,529 B2 * 8/2015 Liang ..... E05F 11/16
9,284,159 B2 * 3/2016 Koskelainen ..... B66B 11/0226
10,119,318 B1 * 11/2018 Wolf ..... E05F 15/63
2003/0075656 A1 * 4/2003 Muir ..... E05C 17/045 248/276.1
2005/0262664 A1 * 12/2005 Smith ..... E05C 17/24 16/366
2011/0203184 A1 * 8/2011 Nguyen ..... E05C 17/24 49/400
2012/0036781 A1 * 2/2012 Runk ..... E05C 17/28 49/181
2013/0283696 A1 * 10/2013 Zhang ..... E05C 17/24 49/322
2015/0240540 A1 * 8/2015 John ..... E05C 17/48 292/281
2019/0078365 A1 * 3/2019 Doring ..... E05C 17/08

* cited by examiner

TAMPER RESISTANT SASH OPENING LIMITER FOR CASEMENT AND AWNING WINDOWS

RELATED APPLICATION

The present application claims the benefit of U.S. Provisional Application No. 62/869,827 filed Jul. 2, 2019, said application being hereby incorporated herein in its entirety by reference.

TECHNICAL FIELD

The inventions relate to opening limit devices for casement and awning windows, in particular to opening limit devices not requiring a release mechanism.

BACKGROUND

Life safety codes require some casement windows to be restricted to 4 inches or less of opening. Current sash limiters that fit into the 7/16" high space available on most residential casement windows are not tamper resistant but rather are made to easily detach. For example, window opening control devices (WOCD) are known, such as disclosed in U.S. Pat. No. 8,505,240, issued Aug. 13, 2013, to the owners of the present invention and entitled CASEMENT AND AWNING WINDOW OPENING LIMIT DEVICE, said patent being hereby fully incorporated herein by reference. Other devices have no detach feature that is provided other than by removing the mounting screws.

It can sometimes be undesirable to allow life/safety devices to be easily overridden.

Current casement sash limiters (other than WOCDs) are mounted to the window sill and restrict the sash to a specific angle of opening which means that the distance the window opens for a specific mounting location will depend on the width of the window and to a lesser extent, on the specific hinges used. The sill mounted limiter location must vary to achieve a specific opening distance which complicates manufacturing of windows. Additionally, some casement windows are so narrow that there is not enough space to fit a limit device on the sill because it competes for space with the hinge or operator.

SUMMARY OF THE DISCLOSURE

The present invention addresses the drawbacks of the prior art devices. In the jamb mounted version, the limiter is mounted in one constant location on the jamb rather than multiple locations on the sill which results in the opening distance being essentially the same for all window widths and all hinge types. The amount of space available for the device does not depend on the window width so it can be used on narrower windows.

Advantages provided by embodiments of the present invention are:

1) Tamper resistance;

2) A common mounting location for all windows; and

3) Works on narrower windows than sill mounted limiters.

In embodiments of the claimed invention, a security screw is used to provide the ability to detach the limiter for maintenance (such as window washing from the interior) while restricting this ability to personnel having a special security tool. A screw with a hexalobular or other shaped drive designed to be installed or removed only with special tools can be used to retain a limiting arm to a stud coupled to a bracket.

In an embodiment, a tamper resistant jamb mounted sash limiter includes a track mounted to the jamb of a casement window (or to the sill of an awning window). A traveler, which may be a slider, engages with the track and has an internally threaded stud attached to it using non-round features on both the stud and the aperture in the slider to prevent rotation of the stud. The aperture at one end of an arm is placed over the stud and a security screw is used to secure the arm to the stud such that the arm is free to rotate about the axis of the stud. The other end of the arm is riveted to a bracket which is mounted to the sash such that it can freely rotate about the axis of the rivet. As the sash opens, the slider progresses along the track until it contacts a screw head (or other obstacle) which stops the roller, preventing further opening of the sash. Throughout the range of motion, the rivet moves angularly as well as laterally relative to the stud, so the arm must be able to also rotate out-of-plane, perpendicular to the axes of the stud and rivet by a limited amount. This is facilitated by making loose fits between the apertures in the arms and the stud and rivet. A bend in the arm near the rivet aperture allows the arm to rotate perpendicular to the rivet axis even farther for a given rivet length without interfering with the sash than if the arm had been straight.

In some embodiments, the internally threaded stud could be integrally formed as part of the slider, or the stud could be knurled while the aperture in the slider is round. The track can have a feature integrally formed into it, or a separate stop component could be attached to the track to provide a stop for the slider. Although the track can form a c-shaped channel with the slider riding in the channel, the track and slider can be any shapes that allow relative sliding motion while also permitting attachment of the threaded stud. The bracket could be mounted to the jamb and the track to the sash.

In another embodiment, a tamper resistant sill mounted sash limiter includes a bracket having an attached cylindrical stud with a vertical axis mounted to the sill of a casement window (or to the jamb of an awning window). The stud is internally threaded to accept a screw. The aperture at one end of an arm is placed over the stud and a security screw (such as one having an internal hexalobular drive with a pin in the center of the drive) is used to secure the arm to the stud such that the arm is free to rotate about the axis of the stud. At the other end of the arm is a roller (or slider) that engages with a track mounted to the sash. As the sash opens, the roller progresses along the track until it contacts a screw head (or other obstacle) which stops the roller, preventing further opening of the sash.

In some embodiments, the stud can be integrally formed as part of the bracket. Also, the track and slider can be any shapes that allow relative sliding motion. The bracket could be mounted to the sash and the track to the sill. A non-round aperture can be employed around the stud in order to prevent the stud from rotating when the security screw is tightened. A threaded stud can be formed into or attached to a slider rather than to the bracket.

According to an embodiment, a sash limiter assembly is provided for a casement window having a sash hinged to a frame, the sash being selectively shiftable within a range of travel to open and close an opening defined by the frame. The sash limiter assembly includes an attachment bracket having a pivot stud projecting therefrom, a track assembly including a track and a traveler, the traveler slidably received by the track, the traveler presenting a projecting stud, and a limiter arm pivotally coupled to the pivot stud and pivotally coupled to the projecting stud of the traveler, wherein the attachment bracket is adapted to attach to a sash of the casement window and the track assembly is adapted to attach to a jamb of the casement window, the limiter arm preventing opening of the sash beyond a predefined range of travel less than the range of travel of the sash. The limiter arm can define at least one bend. The limiter arm may define a first aperture proximate a proximal end and a second aperture proximate a distal end, the pivot stud being received in the first aperture and the projecting stud being received in the second aperture, sufficient clearance being provided between an inner edge of the first aperture and an outer surface of the pivot stud, and sufficient clearance being provided between an inner edge of the second aperture and an outer surface of the projecting stud so that the limiter arm is enabled to rotate out-of-plane relative to a plane defined by the limiter arm.

In embodiments of the sash limiter assembly, the projecting stud receives a security screw to fasten the limiter arm to the traveler, and the security screw may have a hexalobular drive.

In embodiments of the sash limiter assembly, the traveler may be a slider or a roller. The track may define a generally c-shaped channel, the traveler being slidably received in the channel. The track assembly may include at least one stop to prevent the traveler from disengaging from the track. The stop may be a fastener attaching the track to the jamb.

In other embodiments, a casement window includes a frame with a top sill, a bottom sill, and a pair of jambs, the frame defining an opening, and a sash hinged to the frame and pivotally shiftable along a range of travel between a closed position wherein the sash closes the opening and a fully open position wherein the sash is clear of the opening, the sash including a top rail, a bottom rail, and a pair of side rails. The casement window further includes a sash limiter assembly having an attachment bracket having a pivot stud projecting therefrom, the attachment bracket mounted on one of the side rails of the sash, a track assembly including a track and a traveler, the traveler slidably received by the track, the traveler presenting a projecting stud, the track mounted on one of the jambs of the frame, and a limiter arm pivotally coupled to the pivot stud and pivotally coupled to the projecting stud of the traveler, wherein when the sash is shifted from the closed position to the open position, the traveler slides along the track and the limiter arm pivots about the pivot stud and the projecting stud, and the limiter arm prevents opening of the sash beyond a predefined range of travel less than the range of travel of the sash.

In embodiments of the casement window the limiter arm can define at least one bend. Further, the limiter arm can define a first aperture proximate a proximal end and a second aperture proximate a distal end. The pivot stud may be received in the first aperture and the projecting stud received in the second aperture, with sufficient clearance being provided between an inner edge of the first aperture and an outer surface of the pivot stud, and sufficient clearance being provided between an inner edge of the second aperture and an outer surface of the projecting stud so that the limiter arm is enabled to rotate out-of-plane relative to a plane defined by the limiter arm.

In embodiments of the casement window, the projecting stud receives a security screw to fasten the limiter arm to the traveler. The security screw may have a hexalobular drive.

In embodiments of the casement window, the traveler may be a slider or a roller. The track can define a generally c-shaped channel, the traveler being slidably received in the channel. The track assembly can include at least one stop to prevent the traveler from disengaging from the track, and the stop may be a fastener attaching the track to the jamb.

In further embodiments, a sash limiter assembly is provided for a casement window having a sash hinged to a frame, the sash being selectively shiftable within a range of travel to open and close an opening defined by the frame. The sash limiter assembly includes an attachment bracket having a pivot stud projecting therefrom, a track assembly including a track and a traveler, the traveler slidably received by the track, the traveler presenting a projecting stud, and a limiter arm pivotally coupled to the pivot stud and pivotally coupled to the projecting stud of the traveler. The attachment bracket is adapted to attach to a bottom sill of the casement window and the track assembly is adapted to attach to a bottom rail of the casement window, with the limiter arm preventing opening of the sash beyond a predefined range of travel less than the range of travel of the sash.

In embodiments, the pivot stud receives a security screw to fasten the limiter arm to the attachment bracket. The security screw may have a hexalobular drive.

In embodiments of the sash limiter assembly, the traveler may be a slider or a roller. The track can define a generally c-shaped channel with the traveler being slidably received in the channel. The track assembly can include at least one stop to prevent the traveler from disengaging from the track, and the stop can be a fastener attaching the track to the sash.

In embodiments, a casement window includes a frame with a top sill, a bottom sill, and a pair of jambs, the frame defining an opening, and a sash hinged to the frame and pivotally shiftable along a range of travel between a closed position wherein the sash closes the opening and a fully open position wherein the sash is clear of the opening, the sash including a top rail, a bottom rail, and a pair of side rails. The casement window further includes a sash limiter assembly with an attachment bracket having a pivot stud projecting therefrom, the attachment bracket mounted on the bottom sill of the frame, a track assembly including a track and a traveler, the traveler slidably received by the track, the traveler presenting a projecting stud, the track assembly mounted on the bottom rail of the sash, and a limiter arm pivotally coupled to the pivot stud and pivotally coupled to the projecting stud of the traveler, wherein when the sash is shifted from the closed position to the open position, the traveler slides along the track and the limiter arm pivots about the pivot stud and the projecting stud, and the limiter arm prevents opening of the sash beyond a predefined range of travel less than the range of travel of the sash.

In embodiments of the casement window, the pivot stud receives a security screw to fasten the limiter arm to the attachment bracket. The security screw may have a hexalobular drive.

In embodiments of the casement window, the traveler may be a slider or a roller. The track can define a generally c-shaped channel, the traveler being slidably received in the channel. The track assembly can include at least one stop to prevent the traveler from disengaging from the track. The stop may be a fastener attaching the track to the sash.

The summary above is not intended to describe each illustrated embodiment or every implementation of the present disclosure. The figures and the detailed description that follow more particularly exemplify these embodiments.

BRIEF DESCRIPTION OF THE DRAWINGS

Subject matter hereof may be more completely understood in consideration of the following detailed description of various embodiments of the disclosure, in connection with the accompanying drawings, in which.

Figure 1:
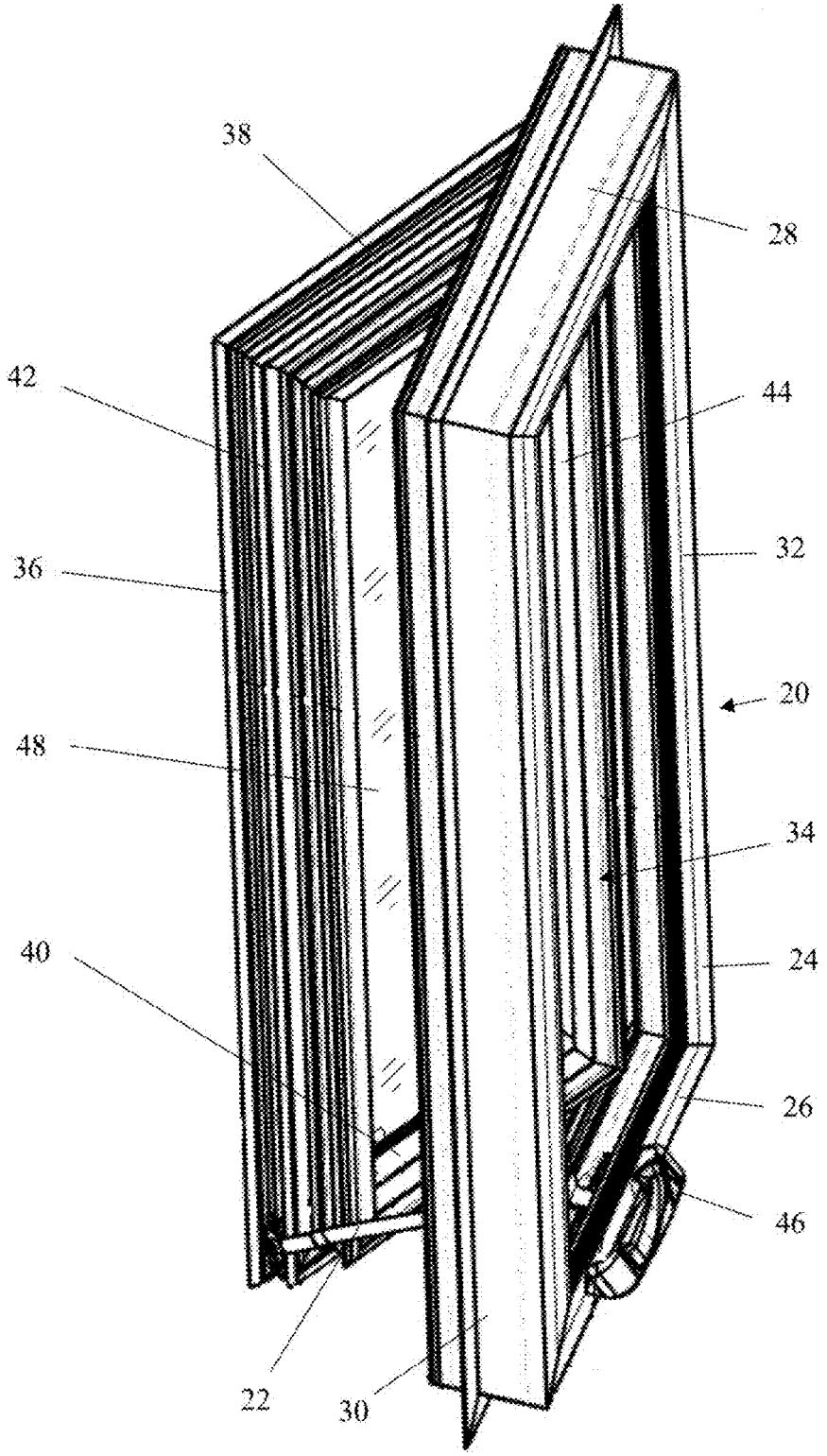
FIG. 1 is an isometric view of a casement window with a jamb mounted sash limiter according to an embodiment of the invention.

While the disclosure is amenable to various modifications and alternative forms, specifics thereof have been shown by way of example in the drawings and will be described in detail. It should be understood, however, that the intention is not to limit the disclosure to the embodiments described. On the contrary, the intention is to cover all modifications, equivalents, and alternatives falling within the spirit and scope of the disclosure as defined by the appended claims.

DETAILED DESCRIPTION

In FIGS. 1 through 9 and 15 there is depicted a casement window 20 with a jamb mounted sash limiter 22 according to an embodiment of the invention. Casement window 20 generally includes frame 24 with bottom sill 26, top sill 28, and jambs 30, 32, defining opening 34, and sash 36. Sash 36 generally includes top rail 38, bottom rail 40, and side rails 42, 44. Sash 36 is rotatably coupled to frame 24 with hinges (not depicted) at the top and bottom to enable sash 36 to be rotated using operator mechanism 46 to open and close opening 34. Sash 36 carries glass 48.

Figure 7:
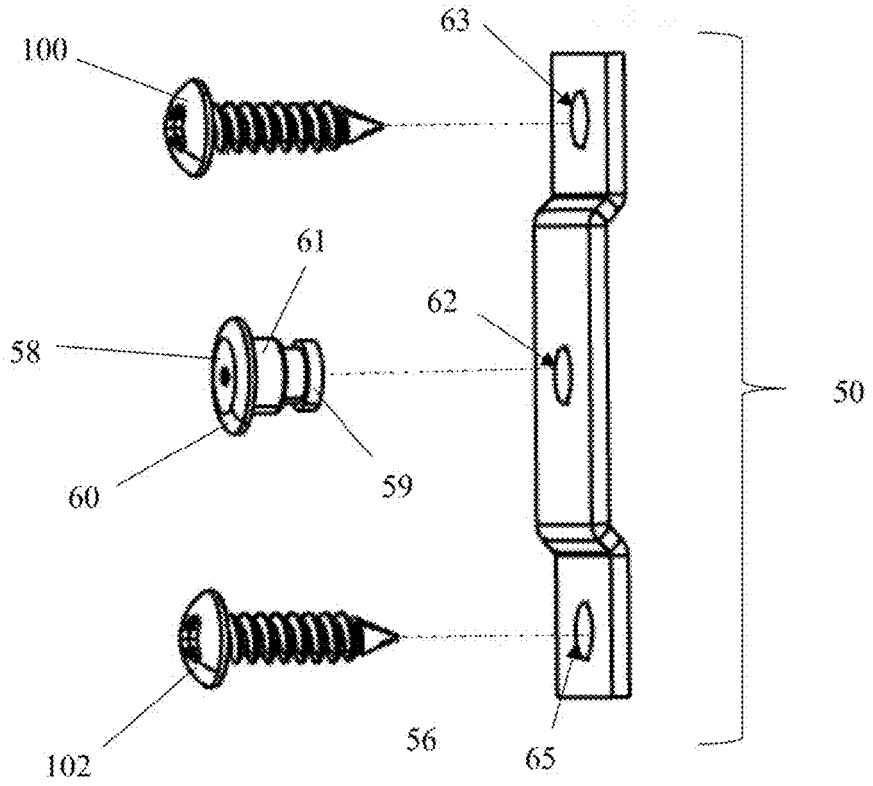
FIG. 7 is an exploded isometric view of the attachment bracket of the jamb mounted sash limiter of FIG. 2.

Sash limiter 22 generally includes attachment bracket 50, limiter arm 52, and track assembly 54. As depicted in FIG. 7, attachment bracket 50 generally includes plate 56 and pivot stud 58. Pivot stud 58 has base 59 and head 60, with shall 61 extending therebetween. Plate 56 defines aperture 62, which receives pivot stud 58, and apertures 63, 65.

As depicted in FIGS. 2, 3, 5 and 6, limiter arm 52 defines aperture 64 with inner edge 67 at proximal end 66 and aperture 68 with inner edge 69 at distal end 70. Bends 72, 74, are formed in limiter arm 52 to enable clearance for out-of-plane rotation as described further hereinbelow.

Figure 4:
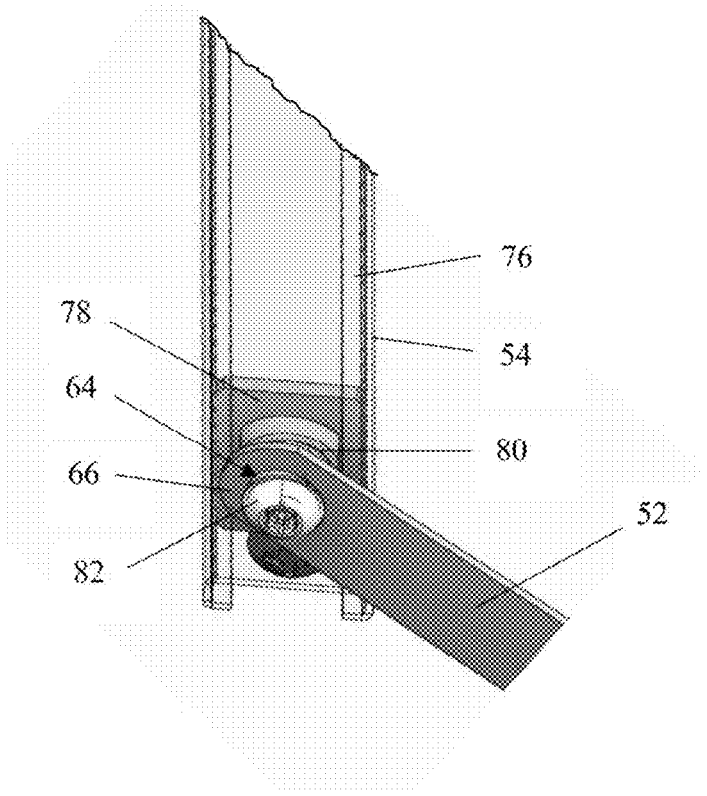
FIG. 4 is a partial isometric view of the track, slider, and limiting arm of the jamb mounted sash limiter of FIG. 2 with the track shown in phantom.
Figure 8:
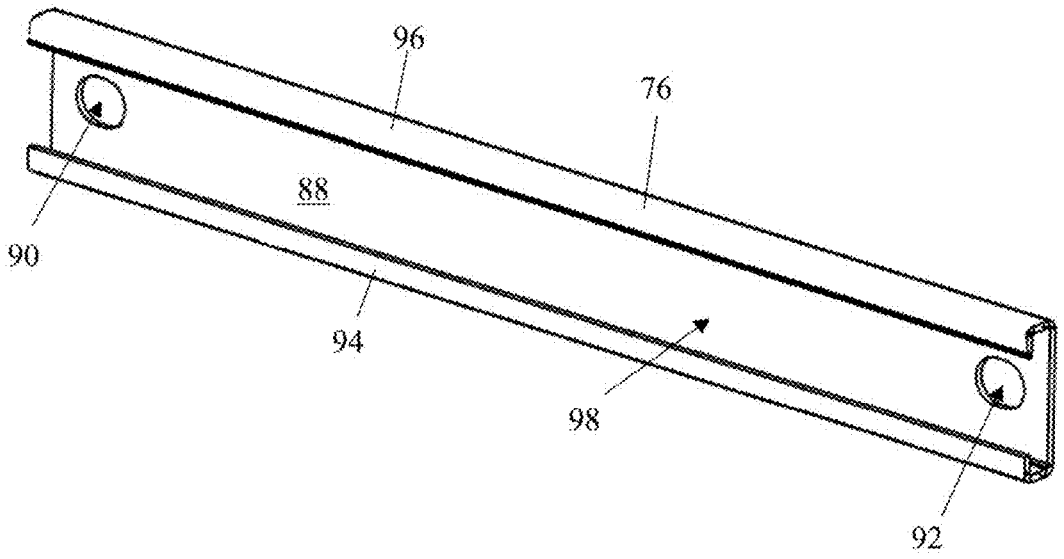
FIG. 8 is an isometric view of the track of the jamb mounted sash limiter of FIG. 2.
Figure 9:
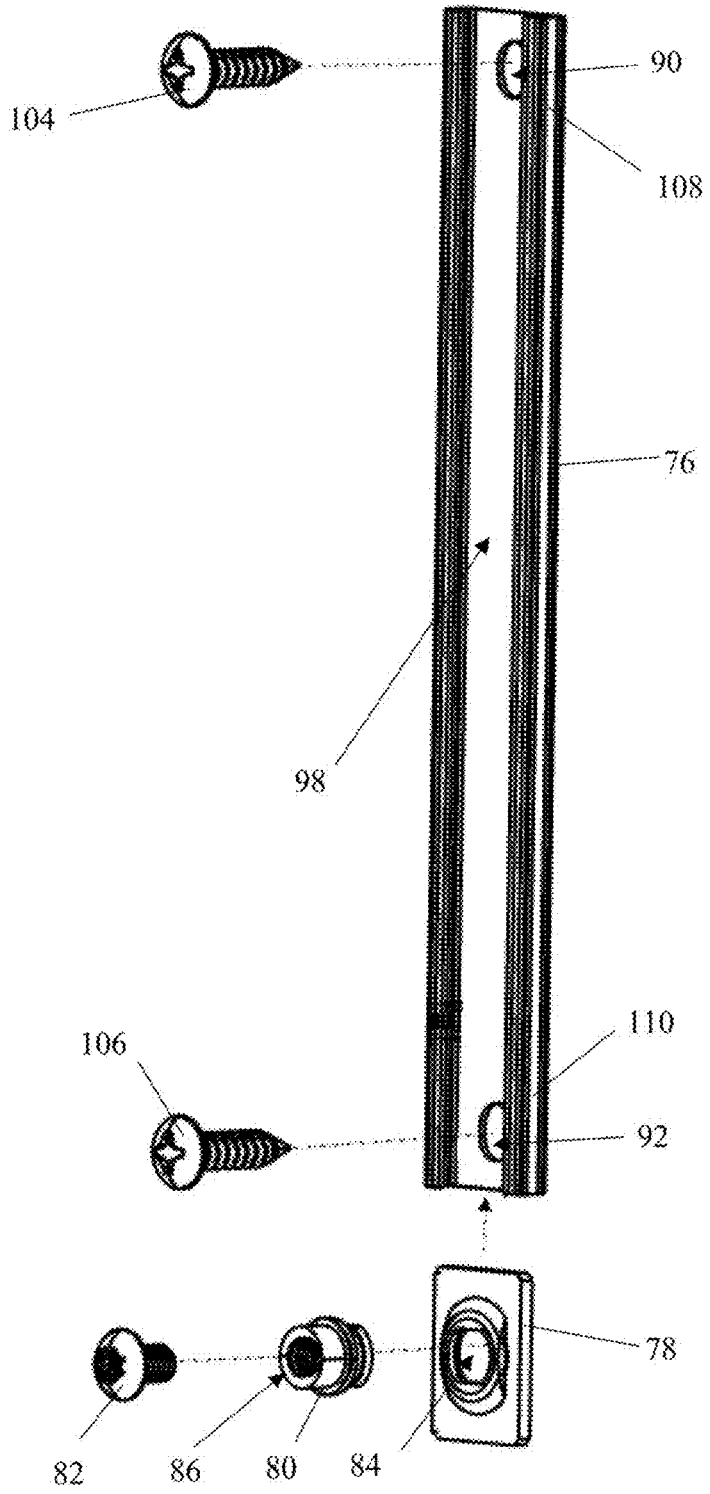
FIG. 9 is an exploded isometric view of the track assembly of the jamb mounted sash limiter of FIG. 2.
Figure 10:
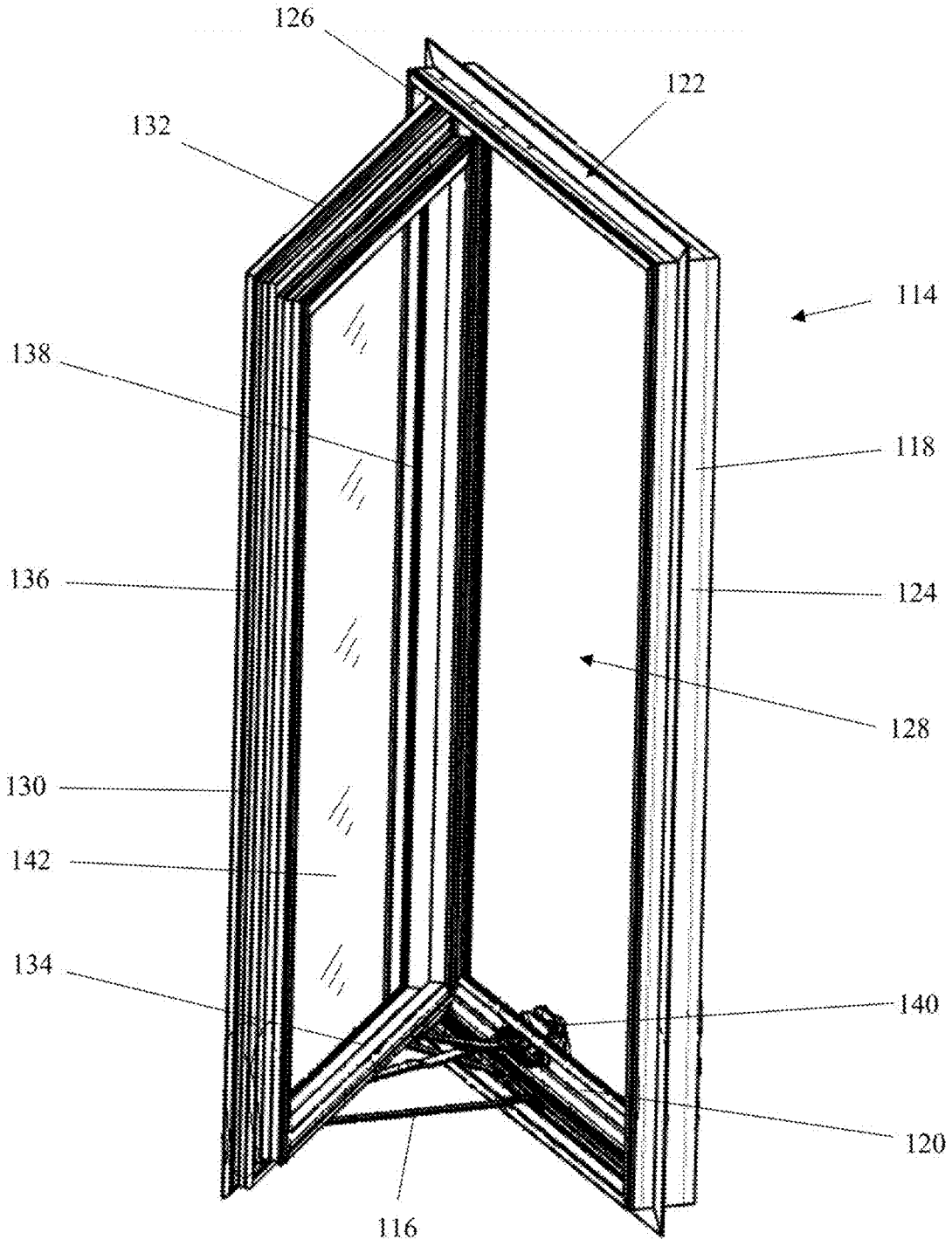
FIG. 10 is an isometric view of a casement window with a sill mounted sash limiter according to another embodiment of the invention.

Track assembly 54, as depicted in FIGS. 4, 8, and 9, generally includes track 76, a traveler in the form of slider 78, projecting attachment stud 80, and security screw 82. Slider 78 defines non-round aperture 84 which receives attachment stud 80, which has non-round portion 81 conforming with non-round aperture 84 to prevent rotation of attachment stud 80 relative to slider 78. Alternatively, aperture 84 could be round, with knerling provided on attachment stud 80, or attachment stud 80 can be integrally formed as a part of slider 78. Attachment stud 80 has internally threaded aperture 86 receiving security screw 82. Security screw 82 may have a hexalobular, one-way, spanner, or other shaped drive to inhibit removal with commonly available tools. As depicted in FIG. 8, track 76 has rear wall 88 defining apertures 90, 92, and side walls 94, 96, defining a generally c-shaped channel 98. Slider 78 is slidably engaged in c-shaped channel 98. It will be appreciated that a roller or other structure capable of traveling in track 76 can be substituted for slider 78 while remaining within the scope of the invention. It will be further appreciated that any other shape of track could be used with a sliding or rolling traveler, so long as the traveler presents a stud or other structure capable of receiving limiter arm 52 and permitting its rotation.

As depicted in FIGS. 1, 2, 5, and 15, attachment bracket 50 is secured to side rail 42 of sash 36 with fasteners 100, 102, through apertures 63, 65. Track assembly 54 is secured to jamb 30 of frame 24 with fasteners 104, 106, through apertures 90, 92. Aperture 64 of limiter arm 52 is received on shaft 61 of pivot stud 58 and is retained by head 61. Aperture 68 of limiter arm 52 is received on attachment stud 80 of slider 78.

Figure 2:
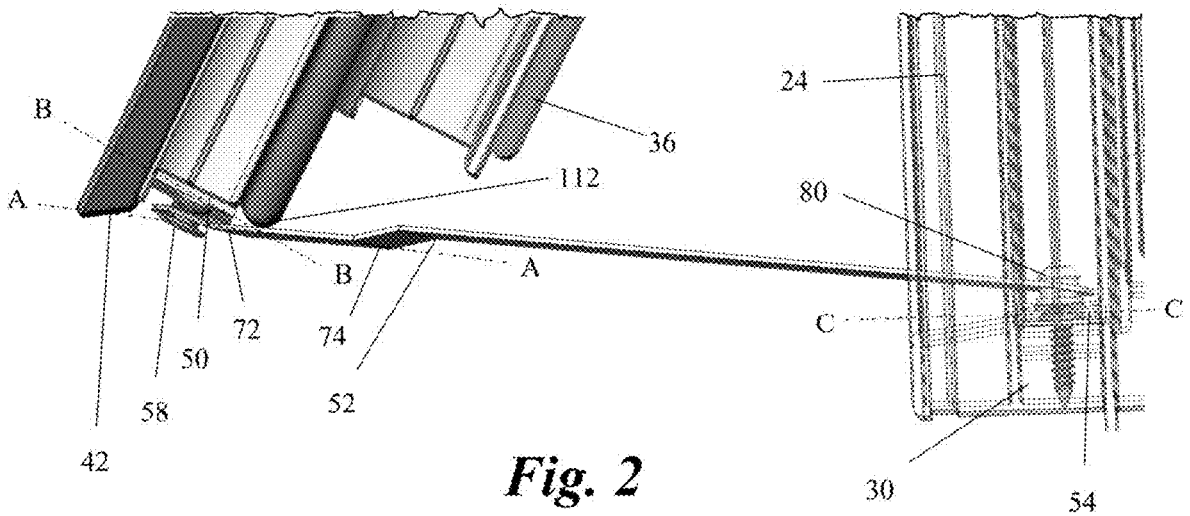
FIG. 2 is a partial top plan view of the jamb mounted sash limiter and casement window of FIG. 1.
Figure 3:
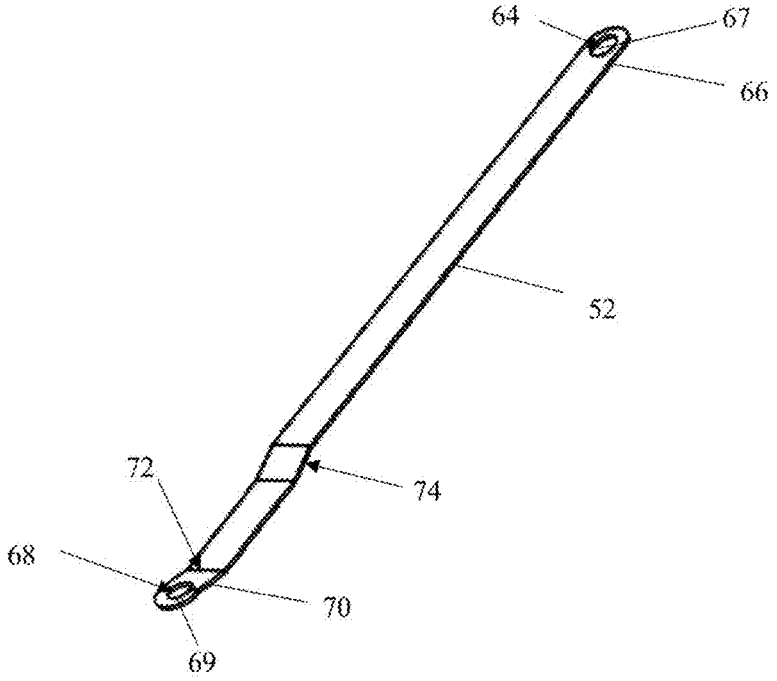
FIG. 3 is an isometric view of the limiting arm of the jamb mounted sash limiter depicted in FIG. 2.
Figure 5:
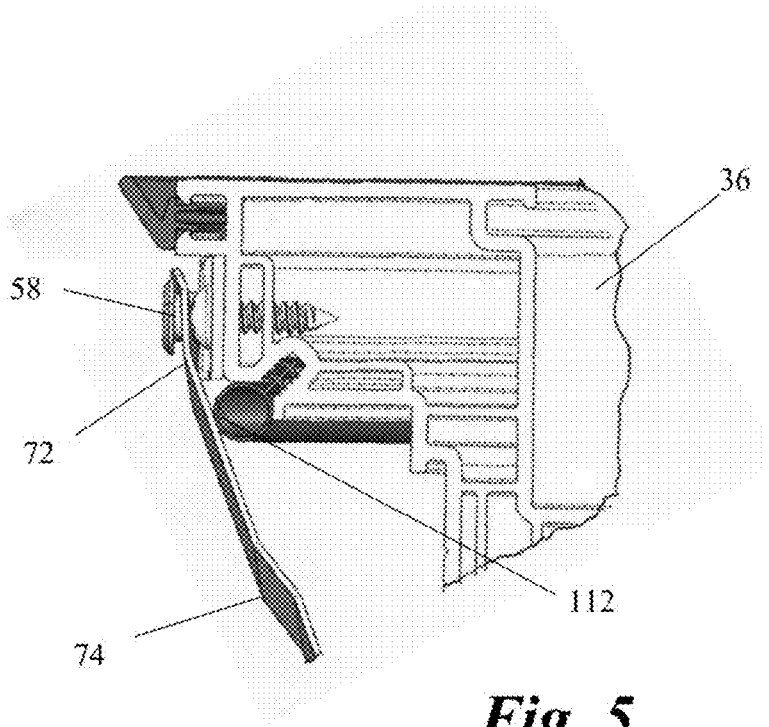
FIG. 5 is a partial top plan view of the jamb mounted sash limiter and casement window of FIGS. 1 and 2, with the sash in an open position, depicting a bend in the arm and connection with the attachment stud enabling out-of-plane rotation of the limiting arm.
Figure 6:
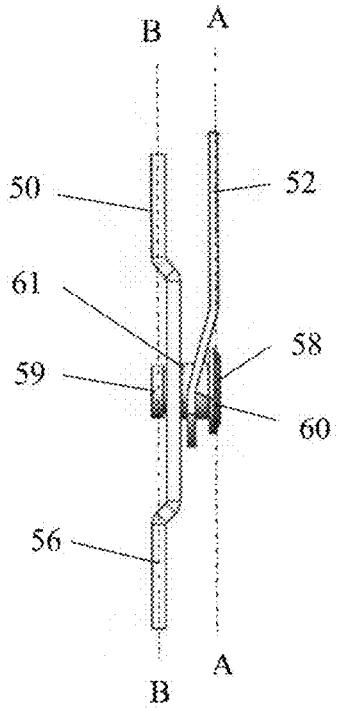
FIG. 6 is an elevation view of the arm and connection with the attachment stud with the sash in a closed position.
Figure 15:
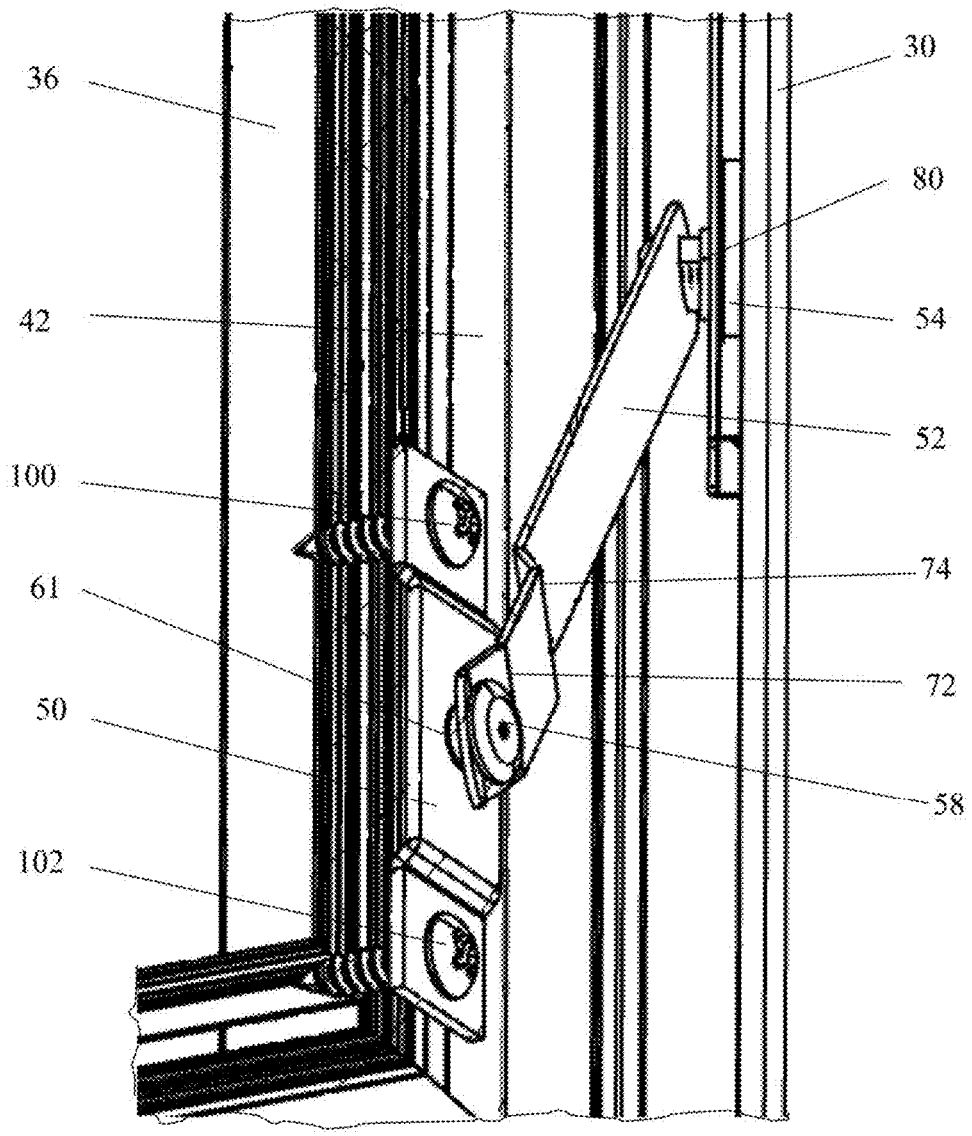
FIG. 15 is a partial isometric view of the attachment bracket of the embodiment of FIGS. 1-9 attached to a window sash, and with part of the sash omitted for purposes of clarity.

In use, with casement window 20 in the closed position with sash 36 received in, and closing, opening 34, limiter arm 52 is oriented vertically as depicted in FIG. 6, with slider 78 proximate top end 108 of track 76. Notably, plane A-A defined by limiter arm 52 is substantially parallel to plane B-B defined by plate 50. As sash 36 is moved with operator mechanism 46 toward the open position depicted in FIG. 1, slider 78 slides downward in track 76 toward bottom end 110. Limiter arm 52 rotates vertically, pivoting on pivot stud 58 and attachment stud 80. The rotation of limiter arm 52 is slightly out-of-plane to follow the rotation of sash 36 as sash 36 swings outward. Sufficient clearance is provided between inner edge 67 of aperture 64 and shaft 61, and inner edge 69 of aperture 68 and attachment stud 80, respectively, to enable limiter arm 52 to be slightly cocked relative to both attachment stud 80 and pivot stud 58 as depicted in FIGS. 2, 5, and 15. As depicted in FIG. 2, plane A-A of limiter arm 52 is not parallel with plane B-B of plate 50, and neither is parallel with plane C-C defined by slider 78 and track 76. Bends 72, 74, enable limiter arm 52 to clear inner edge 112 of sash 36. When proximate bottom end 110 of track 76, slider 78 contacts fastener 106 and is prevented from further downward movement. It will be appreciated that a separate stop component (not depicted) could be attached to track 76 in order to obstruct c-shaped channel 98 thereby functioning similarly to fastener 106, or track 76 could have an integrally formed stop feature. Limiter arm 52 prevents further outward pivoting of sash 36, thereby limiting the opening of casement window 20. Typically, the opening is limited by sash limiter 22 to four inches or less of distance between side rail 42 and jamb 30. It will be appreciated, however, that greater or lesser opening distances can be provided by selecting appropriate lengths for limiter arm 52 and track 76.

It will also be appreciated that, although the depicted embodiment is a left-handed casement window, a mirror image sash limiter 22 can be used with right-handed casement windows.

It will also be appreciated by those of skill that bracket 50 could be attached to jamb 30 and track assembly 54 could be attached to sash 36. Although a casement window is depicted, sash limiter 22 could be similarly employed in an awning type window.

In FIGS. 10 through 14, 16, and 17 there is depicted a casement window 114 with a sill mounted sash limiter 116 according to another embodiment of the invention. Casement window 114 generally includes frame 118 with bottom sill 120, top sill 122, and jambs 124, 126, defining opening 128, and sash 130. Sash 130 generally includes top rail 132, bottom rail 134, and side rails 136, 138. Sash 130 is rotatably coupled to frame 118 with hinges (not depicted) at the top and bottom to enable sash 130 to be rotated using operator mechanism 140 to open and close opening 128. Sash 130 carries glass 142.

Figure 11:
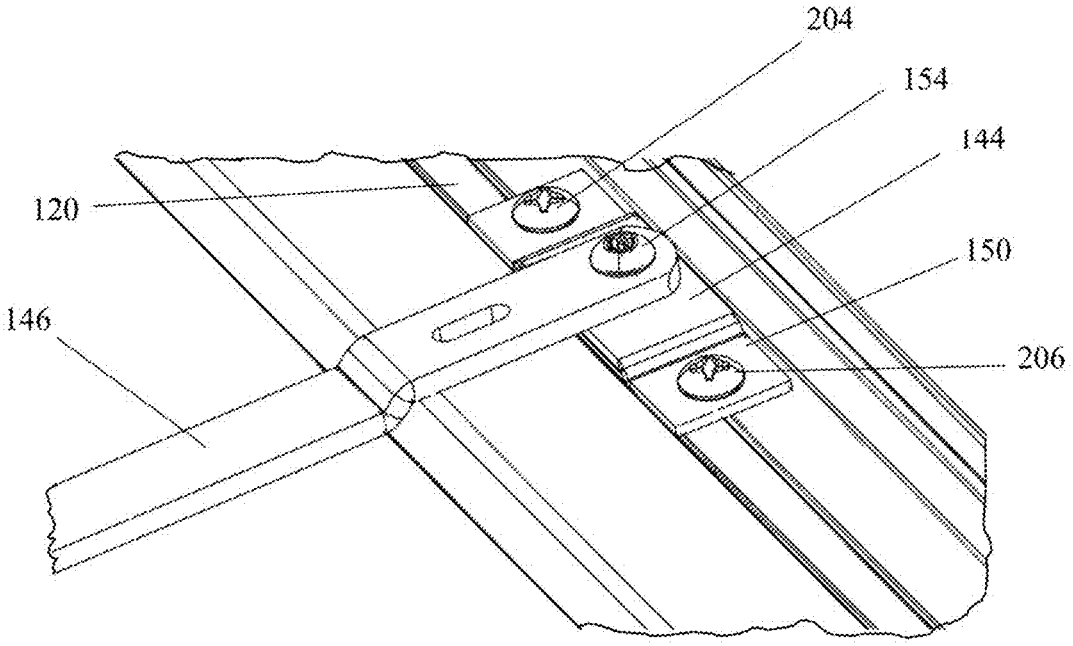
FIG. 11 is a partial isometric view of the limiting arm and sill connection of the casement window and sash limiter of FIG. 10.
Figure 16:
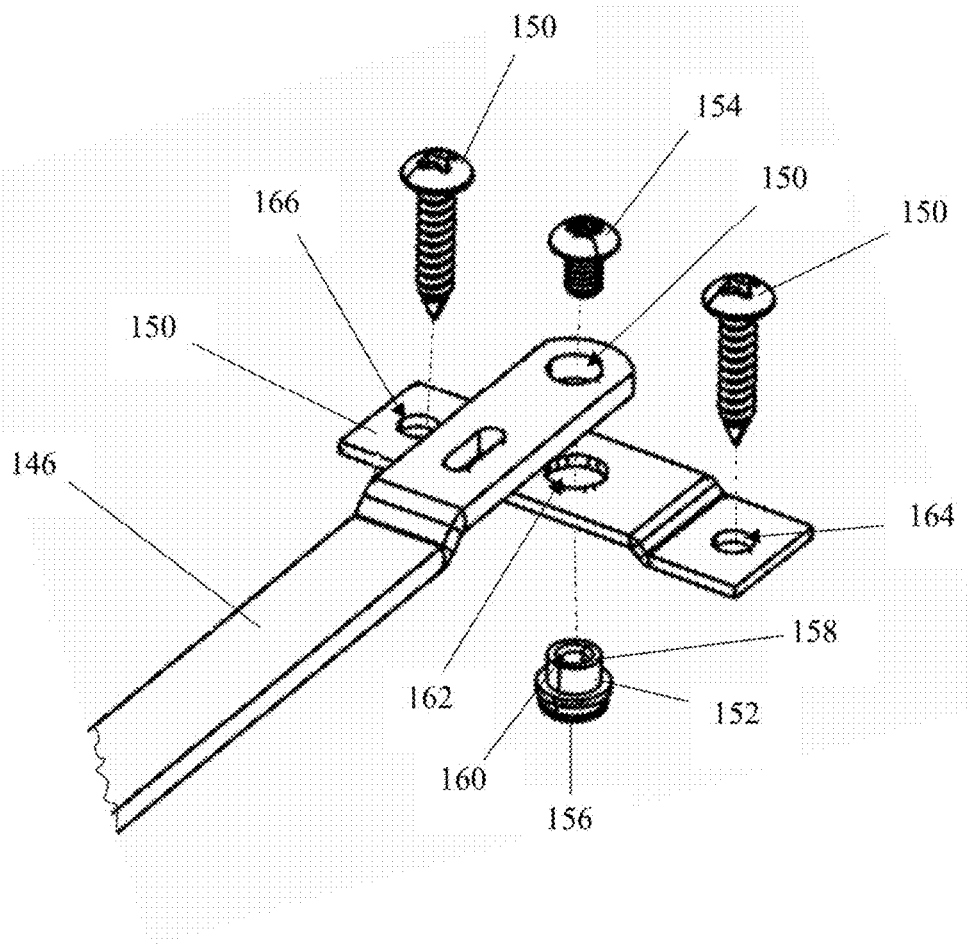
FIG. 16 is an exploded view of the attachment bracket of the embodiment of FIGS. 10-14.

Sash limiter 116 generally includes attachment bracket 144, limiter arm 146, and track assembly 148. As depicted in FIGS. 11 and 16, attachment bracket 144 generally includes plate 150, pivot stud 152, and security screw 154. Pivot stud 152 has base 156 and shank 158, and defines internally threaded aperture 160 receiving security screw 154. Security screw 154 may have a hexalobular, one-way, spanner, or other shaped drive to inhibit removal with commonly available tools. Plate 150 defines central aperture 162 which receives pivot stud 152, and apertures 164, 166.

Figure 14:
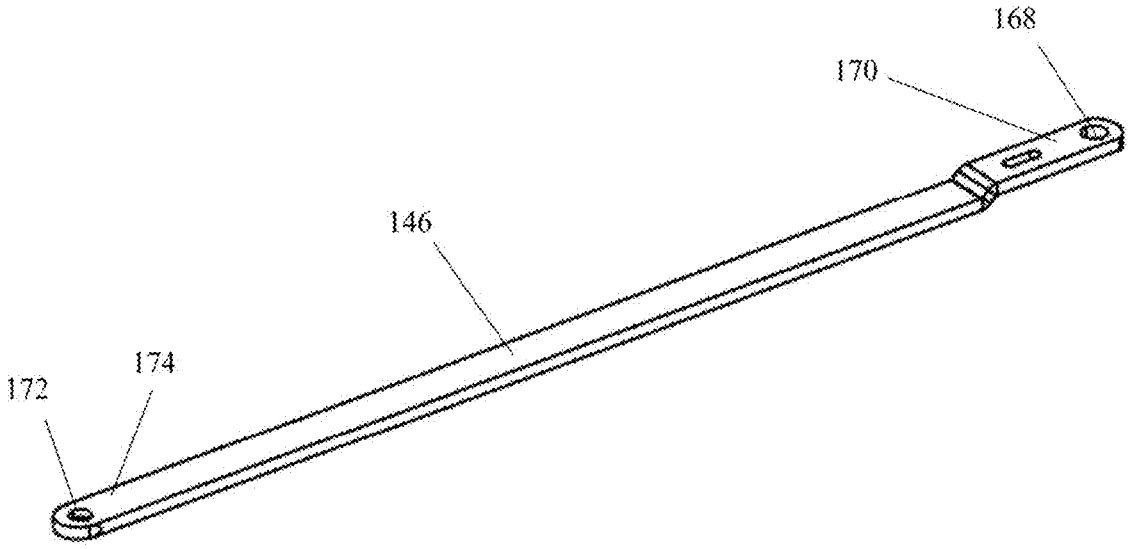
FIG. 14 is an isometric view of the limiting arm of the embodiment of FIGS. 10-13.

As depicted in FIG. 14, limiter arm 146 defines aperture 168 at proximal end 170 and aperture 172 at distal end 174.

Figure 12:
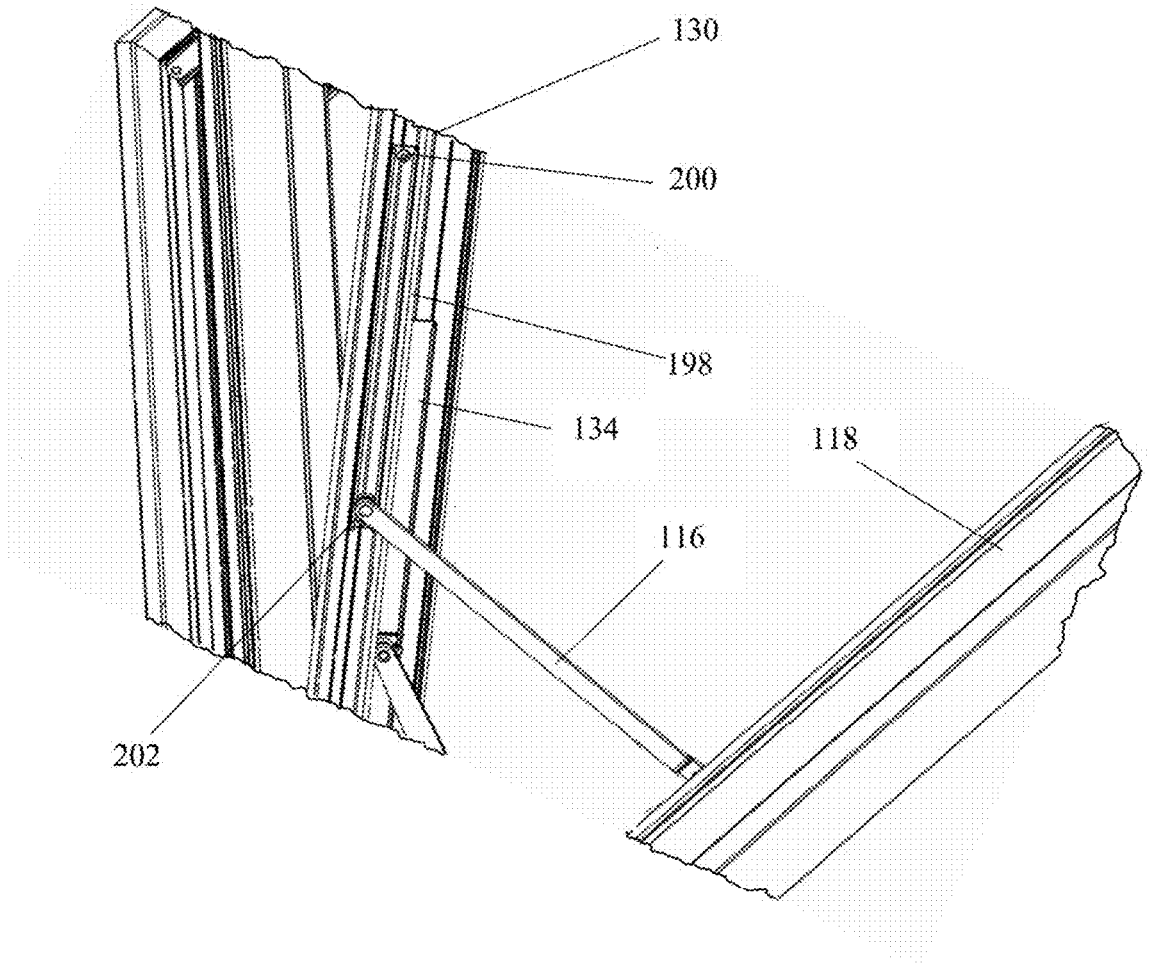
FIG. 12 is a partial bottom isometric view of the casement window and sash limiter of FIG. 10.
Figure 13:
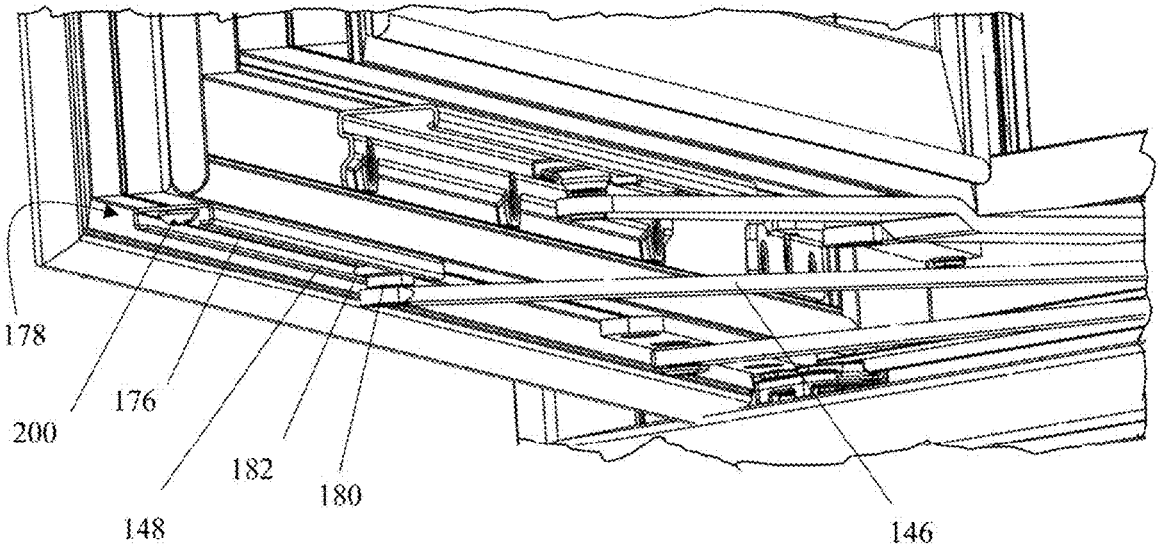
FIG. 13 is a partial bottom isometric view of the casement window and sash limiter of FIG. 10.
Figure 17:
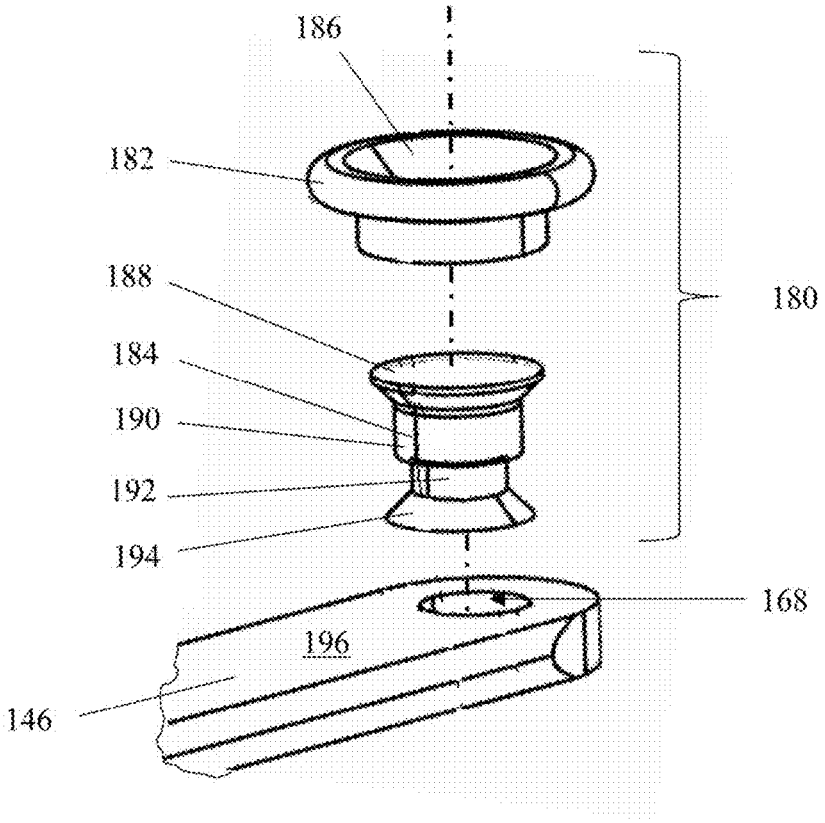
FIG. 17 is an exploded view of the roller assembly of the embodiment of FIGS. 10-14.

As depicted in FIGS. 12 and 13, track assembly 148 generally includes track 176 defining c-shaped channel 178, and a traveler in the form of roller assembly 180. As depicted in FIG. 17, roller assembly 180 generally includes roller 182 and axle 184. Roller 182 has countersunk portion 186. Axle 184 has beveled head 188, bearing portion 190, neck 192, and beveled base 194. Neck 192 is received in aperture 168 of limiter arm 146 with bearing portion 190 abutting upper surface 196. Beveled base 194 is received in a countersunk portion (not depicted) surrounding aperture 168 so that axle 184 is retained in limiter arm 146. Roller 182 is rotatably received on bearing portion 190 with beveled head 188 abutting countersunk portion 186 to retain roller 182 on axle 184.

Track 176 is secured to underside 198 of bottom rail 134 with fasteners 200, 202. Roller 182 rolls in c-shaped channel 178 of track 176. Attachment bracket 144 is secured to bottom sill 120 with fasteners 204, 206. It will be appreciated that a slider (not depicted) could be substituted for roller 182 while remaining within the scope of the invention.

In use, as sash 130 is opened and closed with operator mechanism 140, limiter arm 146 pivots on pivot stud 152 and roller 182 rolls along c-shaped channel 178. As depicted in FIG. 13, once roller 182 nears the end of track 176, fastener 202 prevents roller 182 from exiting track 176 and sash 130 is prevented from opening further. It will be appreciated that a separate stop component (not depicted) could be attached to track 176 in order to obstruct c-shaped channel 178 thereby functioning similarly to fastener 202, or track 176 could have an integrally formed stop feature.

It will also be appreciated that, although the depicted embodiment is a left-handed casement window, a mirror image sash limiter 116 can be used with right-handed casement windows.

It will be appreciated by those of skill in the art that bracket 144 could be attached to sash 130 and track 176 could be attached to bottom sill 120. Also, sash limiter 116 could be attached to top sill 122 and top rail 132 of sash 130. Although a casement window is depicted, sash limiter 116 could be similarly employed in an awning type window.

Typically, the opening is limited by sash limiter 116 to four inches or less of distance between side rail 136 and jamb 124. It will be appreciated, however, that greater or lesser opening distances can be provided by selecting appropriate lengths for limiter arm 146 and track 176.

Various embodiments of systems, devices, and methods have been described herein. These embodiments are given only by way of example and are not intended to limit the scope of the claimed inventions. It should be appreciated, moreover, that the various features of the embodiments that have been described and may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herewith.

For purposes of interpreting the claims for the present invention, it is expressly intended that the provisions of 35 U.S.C. § 112(f) are not to be invoked unless the specific terms "means for" or "step for" are recited in the subject claim.

What is claimed is:

1. A sash limiter assembly for a casement window having a sash hinged to a frame, the sash being selectively shiftable within a range of travel to open and close an opening defined by the frame, the sash limiter assembly comprising:

an attachment bracket having a pivot stud projecting therefrom, the pivot stud defining a longitudinal axis extending perpendicular to the attachment bracket;

a track assembly including a track and a traveler, the traveler slidably received by the track, the traveler presenting a projecting stud, the projecting stud defining a longitudinal axis extending perpendicular to the traveler; and an elongate limiter arm pivotally coupled to the pivot stud and pivotally coupled to the projecting stud of the traveler, the limiter arm presenting a proximal end and a distal end and defining a plane along a longitudinal axis of the limiter arm extending between the proximal end and the distal end, wherein the attachment bracket is adapted to attach to a sash of the casement window and the track assembly is adapted to attach to a jamb of the casement window, the limiter arm preventing opening of the sash beyond a predefined range of travel less than the range of travel of the sash, wherein the limiter arm defines a first aperture proximate the proximal end and defines a second aperture proximate the distal end, the pivot stud being received in the first aperture and the projecting stud being received in the second aperture, sufficient clearance being provided between an inner edge of the first aperture and an outer surface of the pivot stud, and sufficient clearance being provided between an inner edge of the second aperture and an outer surface of the projecting stud so that the limiter arm is enabled to rotate out-of-plane relative to the plane defined by the limiter arm such that the plane of the limiter arm is angled relative to the longitudinal axis of the pivot stud and angled relative to the longitudinal axis of the projecting stud when the sash is at an outer limit of the predefined range of travel.

2. The sash limiter assembly of claim 1, wherein the limiter arm defines at least one bend.

3. The sash limiter assembly of claim 1, wherein the projecting stud receives a security screw to fasten the limiter arm to the traveler.

4. The sash limiter assembly of claim 3, wherein the security screw has a hexa drive.

5. The sash limiter assembly of claim 1, wherein the traveler is a slider.

6. The sash limiter assembly of claim 1, wherein the traveler is a roller.

7. The sash limiter assembly of claim 1, wherein the track defines a generally c-shaped channel, the traveler being slidably received in the channel.

8. The sash limiter assembly of claim 1, wherein the track assembly includes at least one stop to prevent the traveler from disengaging from the track.

9. The sash limiter assembly of claim 8, wherein the stop is a fastener attaching the track to the jamb.

10. A casement window comprising:

a frame including a top sill, a bottom sill, and a pair of jambs, the frame defining an opening;

a sash hinged to the frame and pivotally shiftable along a range of travel between a closed position wherein the sash closes the opening and a fully open position wherein the sash is clear of the opening, the sash including a top rail, a bottom rail, and a pair of side rails; and a sash limiter assembly comprising:

an attachment bracket having a pivot stud projecting therefrom, the attachment bracket mounted on one of the side rails of the sash, the pivot stud defining a longitudinal axis extending perpendicular to the attachment bracket;

a track assembly including a track and a traveler, the traveler slidably received by the track, the traveler presenting a projecting stud, the projecting stud defining a longitudinal axis extending perpendicular to the traveler, the track mounted on one of the jambs of the frame; and an elongate limiter arm pivotally coupled to the pivot stud and pivotally coupled to the projecting stud of the traveler, the limiter arm presenting a proximal end and a distal end and defining a plane along a longitudinal axis of the limiter arm extending between the proximal end and the distal end, wherein the limiter arm defines a first aperture proximate the proximal end and defines a second aperture proximate the distal end, the pivot stud being received in the first aperture and the projecting stud being received in the second aperture, sufficient clearance being provided between an inner edge of the first aperture and an outer surface of the pivot stud, and sufficient clearance being provided between an inner edge of the second aperture and an outer surface of the projecting stud so that the limiter arm is enabled to rotate out-of-plane relative to the plane defined by the limiter arm, wherein when the sash is shifted from the closed position to the open position, the traveler slides along the track and the limiter arm pivots about the pivot stud and the projecting stud, and the limiter arm prevents opening of the sash beyond a predefined range of travel less than the range of travel of the sash and the plane of the limiter arm is angled relative to the longitudinal axis of the pivot stud and angled relative to the longitudinal axis of the projecting stud when the sash is at an outer limit of the predefined range of travel.

11. The casement window of claim 10, wherein the limiter arm defines at least one bend.

12. The casement window of claim 10, wherein the projecting stud receives a security screw to fasten the limiter arm to the traveler.

13. The casement window of claim 12, wherein the security screw has a hexalobular drive.

14. The easement window of claim 10, wherein the traveler is a slider.

15. The casement window of claim 10, wherein the traveler is a roller.

16. The casement window of claim 10, wherein the track defines a generally c-shaped channel, the traveler being slidably received in the channel.

17. The casement window of claim 10, wherein the track assembly includes at least one stop to prevent the traveler from disengaging from the track.

18. The casement window of claim 17, wherein the stop is a fastener attaching the track to the jamb.

* * * * *